US005949278A

United States Patent [19]

Oguey

[11] Patent Number: 5,949,278

[45] Date of Patent: Sep. 7, 1999

[54] REFERENCE CURRENT GENERATOR IN CMOS TECHNOLOGY

[75] Inventor: Henri Oguey, Corcelles, Switzerland

[73] Assignee: CSEM—Centre Suisse d'Electronique et de Microtechnique SA, Neuchatel, Switzerland

[21] Appl. No.: 08/620,419

[22] Filed: Mar. 22, 1996

[30] Foreign Application Priority Data

Mar. 22, 1995 [FR] France ..... 95 03352

[51] Int. Cl.[6] ..... G05F 1/10

[52] U.S. Cl. ..... 327/543; 327/541; 327/538; 323/315

[58] Field of Search ..... 327/538, 540, 327/541, 543, 545, 546; 323/315

[56] References Cited

U.S. PATENT DOCUMENTS

| | | | |
|---|---|---|---|
| 4,342,926 | 8/1982 | Whatley | 327/541 |
| 4,399,374 | 8/1983 | Boeke | 327/538 |
| 4,450,367 | 5/1984 | Whatley | 327/538 |
| 4,495,425 | 1/1985 | McKenzie | 327/541 |
| 4,558,242 | 12/1985 | Tuthill et al. | 327/541 |
| 5,124,632 | 6/1992 | Greaves . | |
| 5,304,861 | 4/1994 | Fruhauf et al. | 327/538 |
| 5,384,740 | 1/1995 | Etoh et al. . | |
| 5,512,855 | 4/1996 | Kimura | 327/538 |

FOREIGN PATENT DOCUMENTS

| | | | |
|---|---|---|---|
| 0454250 | 10/1991 | European Pat. Off. . | |
| 1-183913 | 7/1989 | Japan | 327/541 |

OTHER PUBLICATIONS

"Analog VLSI Signal Processing: Why, Where, and How?", Analog Integrated Circuits and Signal Processing, vol. 6, No. 1, Jul. 1994, Boston, pp. 27–44.

"CMOS Analog Integrated Circuits Based on Weak Inversion Operation", IEEE Journal of Solid–State Circuits, vol. 20, No. 3, Jun. 1985, pp. 657–665.

"The Design of High–Performance Analog Circuits on Digital CMOS Chips", IEEE Journal of Solid–State Circuits, vol. 12, No. 3, Jun. 1977, pp. 224–231.

*Primary Examiner*—Terry D. Cunningham

[57] ABSTRACT

In this generator a first current mirror (MP1, MP2) forms two circuit branches to be connected between supply terminals ($V_{DD}$, $V_{SS}$). Each of the branches includes transistors (MP1, MN1; MP2, MN2) which are series connected and have opposite conductivity types. A second current mirror (MP3, MN3) yields an image ($i_3$) of the current (i1) flowing in one of the branches. An active component (MN4) forming a variable conductance is connected in series in this branch and is controlled in such a way that its value varies nonlinearly with the current image ($i_3$). This conductance is thus traversed by a current whose intensity depends solely on the technological characteristics of the active component.

12 Claims, 4 Drawing Sheets

REFERENCE CURRENT GENERATOR IN CMOS TECHNOLOGY

FIELD OF THE INVENTION

The present invention relates to reference current generators constructed with CMOS technology.

DISCUSSION OF PRIOR ART

FIG. 1 of the appended drawings depicts an example of a reference current generator of this kind constructed according to the prior art. A description thereof may be found in an article by E. Vittoz and J. Felrath in the IEEE publication, Journal of Solid State Circuits, Vol. SC-12, pp. 224–231, June 1977, and entitled "CMOS analog integrated circuits based on weak inversion operation".

This known generator includes two P-channel transistors, MPA and MPB, forming a current mirror, two transistors MNA and MNB which are regulating transistors and a resistor R which forms the element on which the current reference is based. This entire setup is linked up between the supply voltages $V_{DD}$ and $V_{SS}$, it being possible to pick off the reference current from the supply terminal $V_{DD}$ for example. The regulating transistors operate in weak inversion, which means that their gate voltage $V_g$ is less than their threshold voltage $V_T$ and that the drain current $I_D$ decreases exponentially with the source voltage $V_S$, according to the formula:

$$I_D \approx I_{D0}\frac{W}{L}\exp\left(\frac{-V_S}{U_T}\right) \tag{1}$$

where $I_{D0}$ is a parameter which depends on the gate-substrate voltage, W and L are respectively the width and length of the channel and $U_T$ is a voltage proportional to the absolute temperature, which is equal to around 26 mV at ambient temperature. For the transistors MNA and MNB of FIG. 1, which have the same gate voltage and the same channel length, the ratio of the currents is given by:

$$\frac{i_1}{i_2} = \frac{W_{n4}}{W_{nB}}\exp\left(\frac{-V_{S1}}{U_T}\right) \tag{2}$$

Since this ratio is determined by the current mirror MPA-MPB, this relation implies a well-defined value of the source voltage $V_{S1}$ of the transistor MNA:

$$V_{S1} = U_T\ln\left(\frac{i_2 W_A}{i_1 W_B}\right) \tag{3}$$

Since the resistance R and the voltage $V_{S1}$ are determined, the current $i_1$ takes a well-defined value:

$$i_1 = \frac{V_{S1}}{R} \tag{4}$$

Since the objective of the designers of CMOS circuits is in general to create components which have the smallest possible size and the lowest possible consumption, the presence of a resistor in a circuit is often regarded as a considerable drawback. Indeed, especially if the current to be delivered is low, a resistor of high value is needed, this requiring an excessive area of silicon, if the resistivity (sheet resistance) of the layer serving as resistor is low.

Moreover, the reproducibility of the resistor is often poor within standard CMOS technology, this being incompatible with the precision generally a reference current generator must have.

OBJECT OF THE INVENTION

The aim of the invention is to propose a reference current generator which is free of resistors.

BRIEF SUMMARY OF THE INVENTION

The subject of the invention is therefore a reference current generator constructed with CMOS technology comprising a first current mirror which forms two circuit branches to be connected between supply terminals of opposite polarities and each including a group of transistors which are connected in series and have opposite conductivity types, a first of said branches comprising, connected in series with its transistors, stabilization means for imposing a predetermined fixed source voltage on the transistor connected thereto in this first branch, wherein said reference current generator also comprises a second current mirror for generating an image of the current flowing in said first branch, and wherein said stabilization means comprise an active component forming a variable conductance series connected in said first branch and controlled in such a way that its value varies nonlinearly with said current image, said conductance thereby being traversed by a current whose intensity depends solely on the technological characteristics of said active component.

By virtue of these characteristics and in particular the stabilization means such as defined above, the generator according to the invention is formed exclusively of active components which can be easily integrated with high reproducibility and which take up very little room on the integrated circuit chip.

BRIEF DESCRIPTION OF THE DRAWINGS

Other characteristics and advantages of the invention will appear in the course of the following description given merely by way of example with reference to the appended drawings in which.

DETAILED DESCRIPTION OF THE INVENTION

Figure 1:
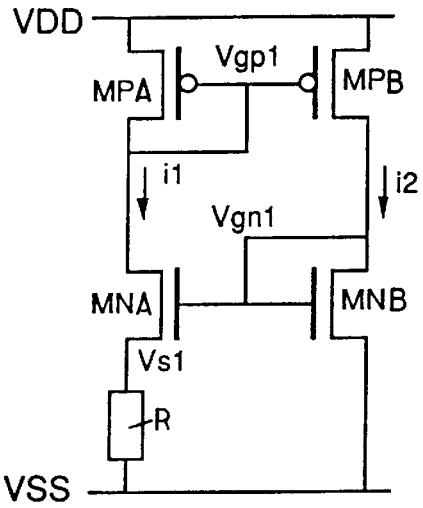
FIG. 1 is a diagram of a reference current generator according to the prior art.
Figure 2:
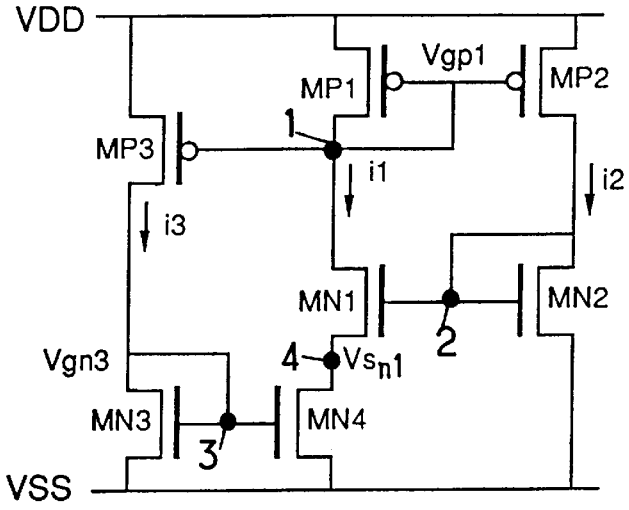
FIG. 2 is a circuit diagram of a reference current generator according to the invention.

Reference will be made firstly to FIG. 2 which depicts a circuit diagram of the preferred embodiment of the invention.

The sources of two P-channel transistors, MP1 and MP2 respectively, are connected to a supply line $V_{DD}$ and their gates are connected to one another to form a node 1. The drains of these transistors are respectively connected to the drains of two N-channel transistors, MN1 and MN2. The connection between the drain of transistor MP1 and transistor MN1 is also connected to the node 1.

The gates of the transistors MN1 and MN2 are also connected together and form a node 2 to which the drain of the transistor MN2 is also connected.

Two N-channel transistors, MN3 and MN4, are connected by their sources to a supply line $V_{SS}$, their gates being connected together to form a node 3 to which the drain of the transistor MN3 is also connected. As will appear below, the transistor MN4 is an active component which operates as a controlled conductance.

The source of the transistor MN1 is connected to the drain of the transistor MN4 thereby forming a node 4, and that of the transistor MN2 is connected to the supply line $V_{SS}$.

The drain of the transistor MN3 is connected to the drain of a P-channel transistor MP3 whose source is connected to the supply line $V_{DD}$ and whose gate is connected to the node 1.

The transistors MN1 and MN2 of this circuit operate in weak inversion, which means that their gate voltage is less than their threshold voltage $V_T$ and that the drain current $I_D$ is a decreasing exponential function of the source voltage $V_s$, according to formula (1). Moreover, the transistors MN3 and MN4 work in strong inversion, in other words their gate voltage is greater than their threshold voltage $V_T$. Finally, the voltage $V_{DD}$ is chosen to be high enough so that with the exception of the transistor MN4 all the transistors are saturated.

It is supposed that the three branches of the circuit, formed by MP1-MN-MN4, MP2-MN2 and MP3-MN3, are traversed by the currents $i_1$, $i_2$ and $i_3$ respectively.

If, moreover, a dimensional ratio S=W/L is defined for each transistor of FIG. 2, then these ratios will be designated $S_{n1}$, $S_{n2}$, $S_{n3}$, $S_{n4}$, $S_{p1}$, $S_{p2}$ and $S_{p3}$ for the seven transistors of the circuit. As already indicated above, the P-channel transistors are saturated so that they define fixed current ratios as follows:

$$\frac{i_2}{i_1} = \frac{S_{p2}}{S_{p1}} \text{ and } \frac{i_3}{i_1} = \frac{S_{p3}}{S_{p1}} \tag{5}$$

The source voltage $Vs_{n1}$ of the transistor MN1, which is also the drain voltage $Vd_{n4}$ of the transistor MN4 , stabilizes at a well-defined value if, as already indicated above, the transistors MN1 and MN2 are under weak inversion, which implies, applying relation (3), as in the prior art circuit:

$$Vs_{n1} = Vd_{n4} = U_T * \ln(K1) \tag{6}$$

with:

$$K_1 = \frac{S_{p2}S_{n1}}{S_{p1}S_{n2}} \tag{7}$$

Moreover $U_T$=kT/q is the thermodynamic voltage, which is proportional to the absolute temperature T and which is equal to around 26 mV at ambient temperature.

In order to aid the understanding of the operation of the generator represented in FIG. 2, it is assumed that a current $i_1$ is conveyed into the drain of the transistor MN1. Through the effect of the current mirror constituted by the transistors MP1 and MP2, an identical current $i_2$ is conveyed into the transistor MN2 whose gate voltage $Vg_{n2}$ adjusts so as to pass this current. This gate voltage is applied also to the gate of the transistor MN1. For this transistor MN1 to deliver the current $i_1$, its source voltage $Vs_{n1}$ must take a positive value, given that this transistor is wider than the transistor MN2. If, as already indicated, the transistors MN1 and MN2 are in weak inversion, hence if $i_1$ is small, this source voltage $Vs_{n1}$ is independent of the current $i_1$ and takes the value given by equation (2).

Through the effect of the current mirror formed by the transistors MP1 and MP3, a current $i_3$ is conveyed into the transistor MN3 and this current takes the form:

$$i_3 = i_1 \frac{S_{p3}}{S_{p1}} \tag{8}$$

Moreover, the transistors MN3 and MN4 are in strong inversion and the transistor MN3 is saturated, hence:

$$i_3 = \frac{1}{2}\beta_{n3}(Vg_{n3} - V_{Tn})^2 \tag{9}$$

This current produces a voltage $Vg_{n3}$ on the gate of the transistor MN3 of the form ($\beta_{n3}$ being the gain factor of the transistor):

$$Vg_{n3} = \sqrt{\frac{2i_3}{\beta_{n3}}} + V_{Tn} \tag{10}$$

The transistor MN4 has the same gate voltage, but its drain voltage $Vd_{n4}$=$Vs_{n1}$ is less than its saturation voltage, and hence ($\beta_{n4}$ being the gain factor of this transistor):

$$i_1 = \beta_{n4} Vs_{n1}\left(Vg_{n3} - V_{Tn} - \frac{1}{2}Vs_{n1}\right) \tag{11}$$

Combining equations (8), (10) and (11), the current $i_1'$ which flows in the transistor MN4 is given by:

$$i_1' = \beta_{n4}\left[Vs_{n1}\sqrt{\frac{2i_1 S_{p3}}{\beta_{n3}S_{p1}}} - \frac{1}{2}Vs^2{}_{n-1}\right] \tag{12}$$

We obtain the same expression if the effect of the transistor MN4 is expressed through its equivalent resistance:

$$R = \frac{Vs_{n1}}{i_1} = \frac{1}{\beta_{n4}\left(Vg_{n3} - V_{Tn} - \frac{1}{2}Vs_{n1}\right)} \tag{13}$$

The current $i_1$, expressed with the help of this relation (13) and of relation (4), again depends on $Vg_{n3}$. Eliminating $Vg_{n3}$ and $i_3$ using equations (8) and (10), we recover the expression (12).

Figure 6:
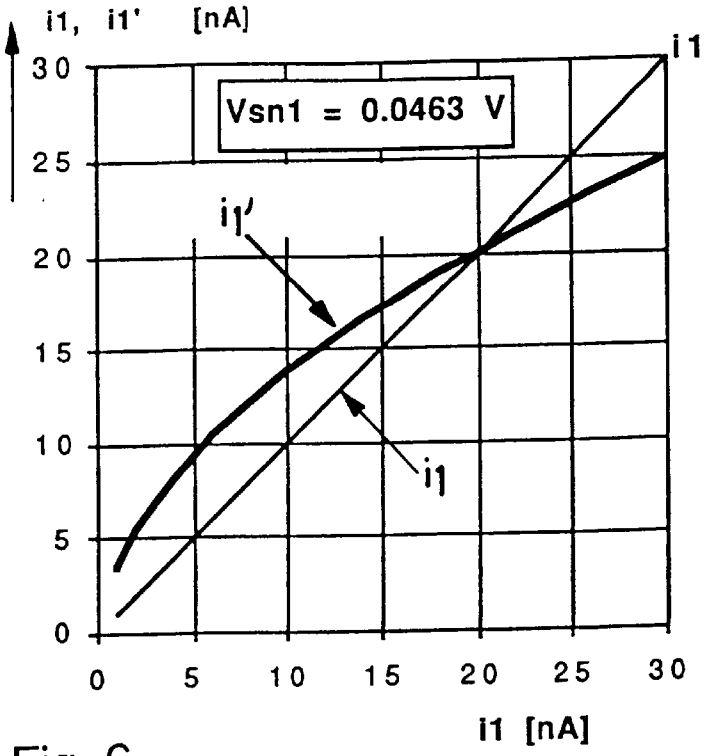
FIG. 6 is a chart illustrating the operation of the generator according to the invention.

FIG. 6 shows the shape of this current $i'_1$, the abscissa of the graph giving the current $i_1$ imposed by the current mirror and the ordinate giving the theoretical currents determined by the above equations.

It may therefore be seen that the current which prevails corresponds to equality (the point of intersection of the curves) between the current $i_1$ conveyed into the source of the transistor MN1 and the current $i_1'$ produced in the transistor MN4. Now, equation (12) shows that this current is a parabolic function of $i_1$ since the transistor MN3 is saturated, whereas the transistor MN4 is operating in the unsaturated regime by virtue of its low drain voltage.

Actually, there is only one condition which can prevail in the circuit, namely when $i_1'$=$i_1$. Consequently, the actual current $i_R$ in the branch of the circuit which includes the transistors MN1 and MN4 is given by:

$$i_R = \beta_{n4} V s_{n1}^2 \left[ K_2 - \frac{1}{2} + \sqrt{K_2(K_2 - 1)} \right] \quad (14)$$

with:

$$K_1 = \frac{S_{p3} S_{n4}}{S_{p1} S_{n3}} \quad (15)$$

Substituting $Vs_{n1}$ (equation 6) into equation (14) gives:

$$i_R = K_{eff} \beta_{n4} U_T^2 \quad (16)$$

in which:

$$K_{eff} = \left[ K_2 - 0,5 + \sqrt{K_2(K_2 - 1)} \right] \ln^2(K_1) \quad (17)$$

Equations (10) and (11) show that:

a) the current $i_R$ is proportional to the product of the gain factor $\beta_{n4}$ of the transistor MN4 and the square of the thermodynamic voltage $U_T$;

b) the proportionality factor $K_{eff}$ depends solely on the dimensional ratios of the transistors; and c) the current $i_R$ is independent of the threshold voltages $V_T$ of the transistors employed.

It follows therefore that the current $i_R$ is a stable parameter of the circuit, so that it constitutes a current reference. It will be noted that this current is determined only by the dimensioning of the transistors, in other words by the topography of the circuit, this being accurately reproducible from circuit to circuit.

Moreover, it is known that the gain factor of a transistor depends on the absolute temperature in the same manner as the mobility, according to the law (applied to the transistor MN4):

$$\beta_{n4} = \beta_{n40} \left( \frac{T_0}{T} \right)^m = \beta_{n40} \left( \frac{U_{T0}}{U_T} \right)^m \quad (18)$$

where $\beta_{n40}$ and $U_{T0}$ relate to a reference temperature $T_0$ (ambient temperature), and m is an exponent of around 2. Combining equations (16) and (18), the current $i_R$ becomes:

$$i_1 = K_{eff} \beta_{n40} U_{T0}^2 \left( \frac{T}{T_0} \right)^{2-m} \quad (19)$$

Since the first three terms in this equation are defined at a given temperature and if m is around 2, it can be seen that the current varies little with temperature, this constituting another advantage of the circuit of the invention.

The current reference can be picked off from the supply terminal $V_{DD}$, the current serving as reference then being formed by the sum of the currents $i_1$ ($i_R$), $i_2$ and $i_3$.

Figure 3:
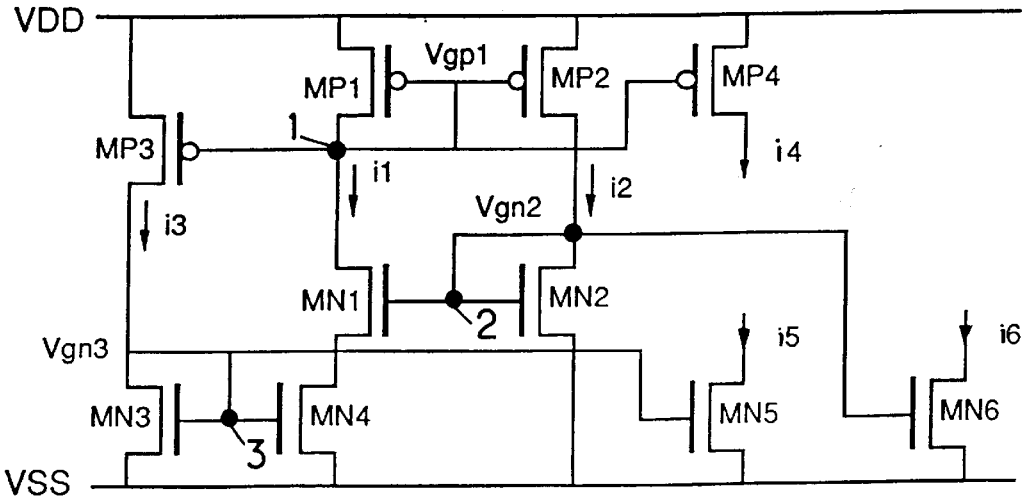
FIG. 3 depicts a diagram of a reference current generator which makes it possible to deliver a reference current to several users.

Reference will now be made to FIG. 3 which shows the way in which the reference current generator can produce several other reference currents.

The circuit of FIG. 3 utilizes the diagram of FIG. 2 so that the same transistors appear therein, connected in the same way. It shows three other ways of yielding a reference current.

The first consists in using an additional P-channel transistor MP4 whose gate is connected to node 1. Its source is connected to the terminal $V_{DD}$, whilst the reference current $i_4$ can be picked off from the drain of this transistor.

The second possibility consists in using an N-channel transistor MN5 whose gate is connected to the drain of the transistor MN3, whose source is connected to the terminal $V_{SS}$ of the circuit and whose drain will receive the reference current $i_5$.

The third possibility consists in again using an N-channel transistor MN6 whose gate is connected to node 2 and which otherwise is connected in the same way as the transistor MN5. It will be supplied with the reference current $i_6$.

For the transistors MP4, MN5 and MN6 to deliver currents which are close to the desired reference currents, they must be saturated, i.e. their drain-source voltage must, in absolute value, be greater than a limit $Vd_{sat}$. This involves connecting the circuit supplied via the transistor MP4 to a lower potential than the voltage $V_{DD}$, for example the voltage $V_{SS}$, and connecting the circuits supplied via the transistors MN5 and MN6 to a higher potential than the voltage $V_{SS}$, for example $V_{DD}$.

Since the gates of these auxiliary transistors MP4, MN5 and MN6 do not load the nodes to which they are connected, their number can be multiplied and reference currents can thus be delivered at numerous points of a larger circuit of which the current generator can form part.

Figure 4:
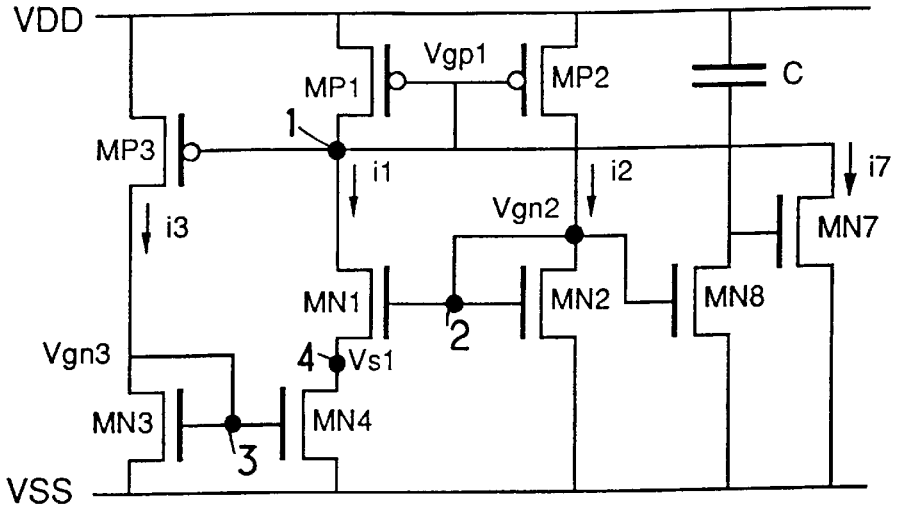
FIG. 4 shows an example of a startup circuit for the generator according to the invention.

FIG. 4 shows more particularly an example of a startup circuit for the reference current generator according to the invention. Such a circuit is indeed required in order to preclude the generator from remaining initially locked. In the example depicted, the startup circuit comprises an N-channel transistor MN7 whose source is connected to the terminal $V_{SS}$ and whose drain is connected to the node 1. The circuit furthermore comprises a second N-channel transistor MN8 whose gate is connected to node 2, whose source is connected to the terminal $V_{SS}$ and whose drain is connected both to the gate of the transistor MN7 and to a capacitor C which is connected moreover to the terminal $V_{DD}$.

The capacitor C is discharged on startup, this turning on the transistor MN7 and causing an initial current to flow in the transistors MP1 to MP3. When the circuit is traversed by a sufficient current, the transistor MN8 charges the capacitor C, thus turning off the transistor MN7. The generator then operates in its normal regime.

Figure 5:
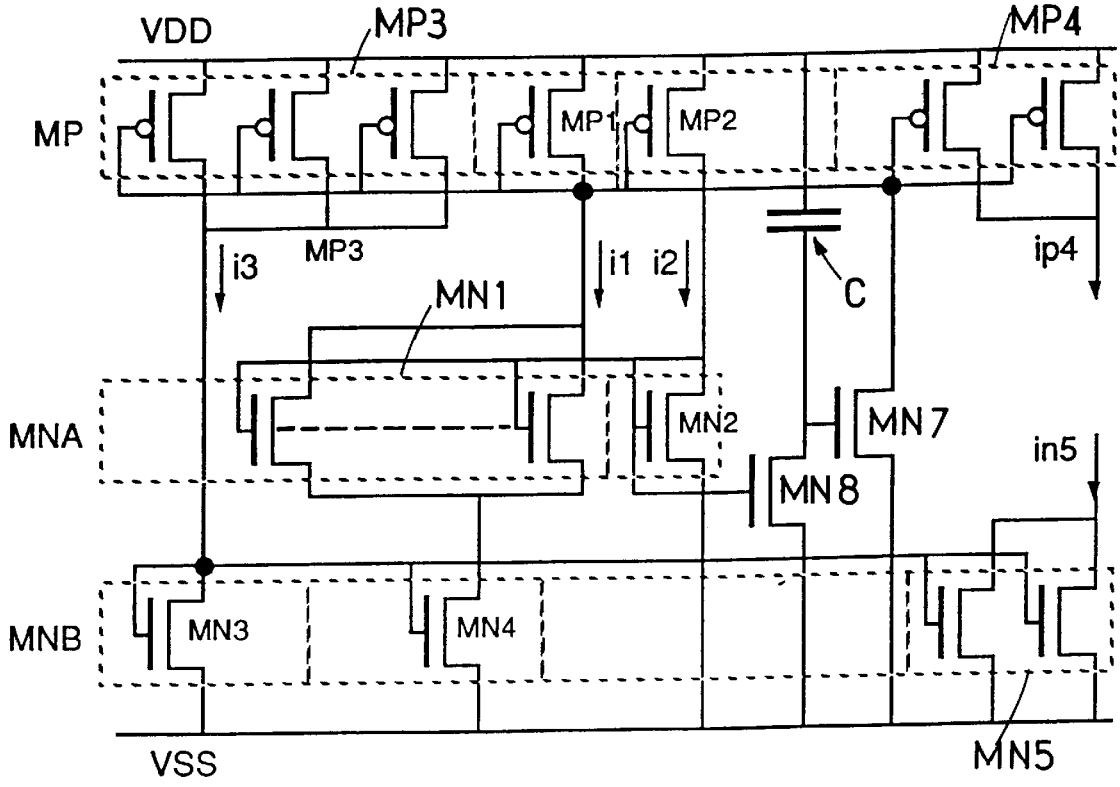
FIG. 5 depicts a diagram of a practical embodiment of the generator according to the invention.

FIG. 5 shows diagrammatically an advantageous way of constructing the generator according to the invention. This diagram comprises the transistors for producing a reference current as well as those enabling the circuit to be started up.

In order to embody the topography of the generator, it is advantageous to distribute the transistors according to the nature of their conditions of operation. Thus, all the strong-inversion P-channel transistors preferably belong to a first group MP, the weak-inversion N-channel transistors to a second group MNA, whilst a third group comprises the strong-inversion N-channel transistors.

To achieve accurate pairing, it is advantageous to define a unit transistor in each group and to effect the various functionalities of the transistors by connecting in series or in parallel the number of unit transistors desired for the right dimensional ratio. For example, the transistor MN1 of FIG. 2 can actually be formed of six unit transistors arranged in parallel.

To obtain strong inversion it is desirable to comply with the following relation:

$$\frac{i}{\beta} > 5 \cdot 10^{-3} V^2 \tag{20}$$

To achieve weak inversion the following relation will preferably be complied with:

$$\frac{i}{\beta} < 0{,}5 U_T^2 \cong 3 \cdot 10^{-4} V^2 \tag{21}$$

If the reference currents are imposed, relations (19) and (20) define the conditions to be satisfied on the gain factors β.

Referring to the example of FIG. 5, the following dimensional ratios can be used (without this being in any sense limiting in respect of the invention):

$$K_1 = \frac{\beta_{n1}}{\beta_{n2}} = \frac{W_{n1}}{W_{n2}} \tag{22}$$

and $$K_2 = \frac{\beta_{p3}}{\beta_{p1}} = \frac{W_{p3}}{W_{p1}} \tag{23}$$

In the example which follows we have chosen $K_1$=6 and $K_2$=3. This example provides some guidelines regarding a practical design of the reference current generator according to the invention, constructed with the aid of present-day CMOS technology, the main parameters of which have the following typical values:

| Type of transistor | N-channel | P-channel |
|---|---|---|
| $V_T$* | 0.6 | −0.6 |
| β for W = L** | 65 | 24 |

*in Volts; **in $\mu A/V^2$

The values of the currents can be chosen as follows:

$i_1$=20 nA, $i_2$=20 nA, $i_3$=60 nA, $i_4$=40 nA and $i_5$=120 nA.

As already indicated, it is advantageous to design the generator with the help of three groups of transistors. Under these conditions, all the transistors in each group can be identical and have for example the following dimensions:

| | Group MP | Group MNA | Group MNB |
|---|---|---|---|
| W* | 6 | 50 | 6 |
| L* | 50 | 6 | 207 |
| i/β | $6.67 \cdot 10^{-3}$ | $3.7 \cdot 10^{-5}$ | $3 \cdot 10^{-2}$ |
| β** | 2.88 | 542 | 1.88 |

*in $\mu$m; **in $\mu A/V^2$

It can be seen from this example that the generator according to the invention is very suitable for delivering reference currents of less than 1 $\mu$A. It is of small size, whilst its own consumption may be of the order of just $5i_1$.

Figure 7:
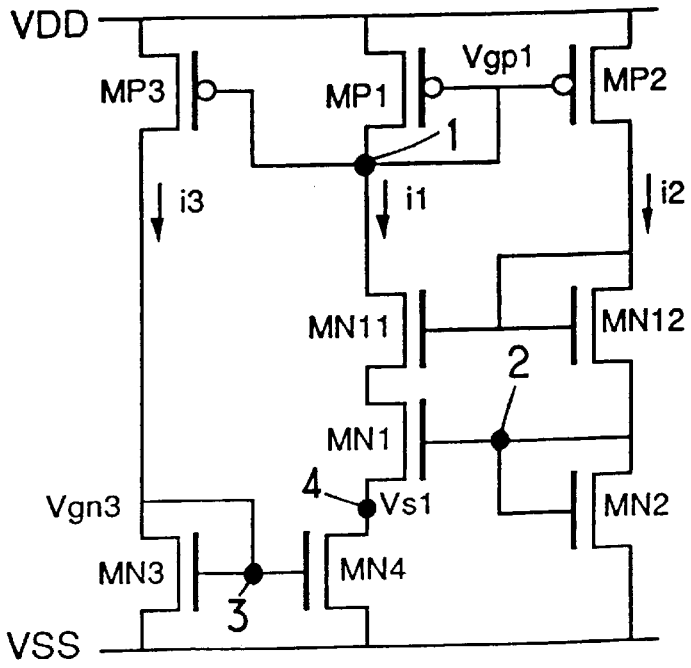
FIGS. 7, 8 and 9 show variant embodiments of the generator according to the invention.
Figure 8:
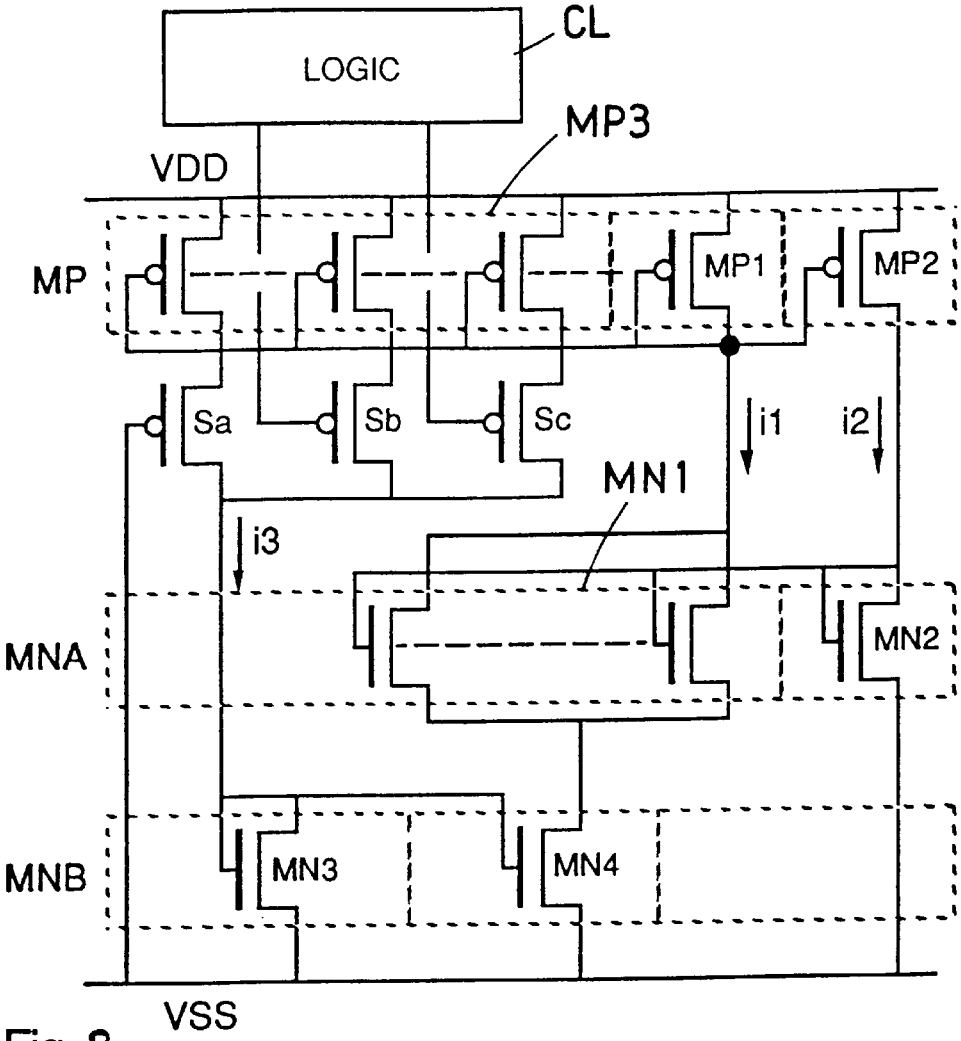
Figure 9:
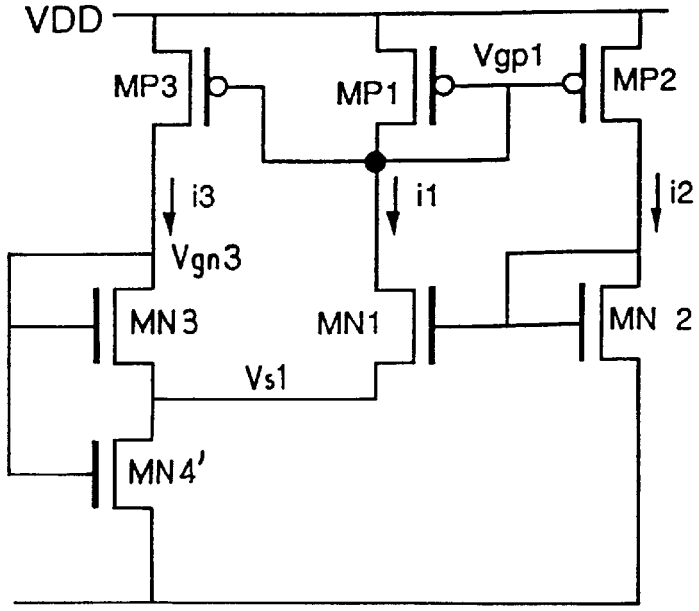

FIGS. 7, 8 and 9 show three variants of the reference current generator according to the invention.

In the embodiment of the generator just described (FIGS. 3, 4 and 5), the transistors in saturation can, for a given gate voltage and especially if the length of their channel is small, exhibit a slight variation in drain current versus drain voltage. Thus, the reference current may experience a degree of dependence on the supply voltage (a few % per volt). In the circuit depicted, the transistors MN1 and MN2 are especially responsible for this effect.

If the accuracy of the reference current does not tolerate this dependence, it is then desirable to use the circuit depicted in FIG. 7.

In this circuit, two auxiliary transistors MN11 and MN12 (termed "cascode transistors") are respectively series connected with the transistors MN1 and MN2. The gates of these transistors are jointly connected to the node between the transistor MN12 and the transistor MP2. It follows that the drain voltages of the transistors MN1 ad MN2 are substantially equal and independent of the variations in the voltage $V_{DD}$.

FIG. 8 shows a variant offering the possibility of adjusting the reference current from outside the circuit. To achieve this result, the transistor MP3 is broken down into several unit transistors MP3*a*, MP3*b*, MP3*c* . . . which are respectively series connected with the same number of P-channel switching transistors Sa, Sb, Sc . . . The gate of the first transistor Sa is connected directly to the terminal $V_{SS}$. It is therefore permanently on. The gates of the other transistors Sb Sc . . . are linked up to a control logic circuit CL enabling these transistors to be turned on selectively. Thus, the effective width of the transistor MP3, i.e. its parameter $K_2$ (equation 15), can be adjusted from outside. This results in a corresponding variation in the parameter $K_{eff}$ (equation 16) and therefore in the current $i_1$ (equation 20). This circuit is especially desirable if, during manufacture, the spread in current from one batch of circuits to another is large.

FIG. 9 shows a third variant of the generator according to the invention in which, all things being otherwise equal considering FIG. 2, the source of the transistor MN3 is connected to the drain of a transistor MN4' and to the source of the transistor MN1 at a node having a fixed potential.

In this case, the transistor MN4' is therefore traversed by the sum of the currents $i_1$ and $i_3$. Almost the same operation as that of the circuit of FIG. 2 is then obtained by dimensioning the transistor MN4' such that it exhibits the same drain voltage as the transistor MN4, but for a current $i_1+i_3$ instead of $i_1$, that is to say $K_2$+1 times greater.

The invention is not limited to the embodiments just described and depicted in the drawings. For example, embodiments which include circuits which have the same functionalities but are constructed with the help of transistors with opposite conductivity types also belong to the present invention.

I claim:

1. A reference current generator constructed using CMOS technology and containing no resistors comprising a first current mirror including two circuit branches, each connected between supply terminals having a voltage difference therebetween and each including a pair of transistors which are series connected and have opposite conductivity types, a first of said branches comprising, series connected with its transistors, stabilization means for imposing a predetermined fixed voltage on the transistor connected thereto in said first branch, wherein said reference current generator also includes a second current mirror for generating a current image of the current flowing in said first branch, and wherein said stabilization means comprise an active component forming a variable conductance series connected in said first branch and controlled in such a way that the value of said conductance varies nonlinearly with said current image wherein said conductance is traversed by a current whose magnitude depends solely on the physical characteristics of said active component and of transistors in said first and second current mirrors, and output means connected to at least one of said branches for supplying a reference current the value of which is a function of the current flowing in at least one of said first and second branches.

2. The reference current generator as claimed in claim 1, wherein said active component includes a transistor operating in the unsaturated region and in strong inversion.

3. The reference current generator as claimed in claim 2, wherein said second current mirror includes a third circuit branch comprising a third pair of series connected transistors, respectively of opposite conductivity types, the midpoint of said third pair of series connected transistors being coupled to said active component for controlling the conductance thereof.

4. The reference current generator as claimed in claim 3, wherein the gate of said transistor included in said active component is connected to said midpoint of said third pair of series connected transistors, one of said third pair of series connected transistors being of the same conductivity type as said transistor included in said active component, and having its gate connected to said midpoint and its source to a node receiving a fixed potential.

5. The reference current generator as claimed in claim 4, wherein said node receiving a fixed potential is a node within said first branch connected to said transistor included in said active component (MN4').

6. The reference current generator as claimed in claim 4, wherein said transistor included in said active component is connected to one of said supply terminals and wherein said node receiving a fixed potential is said one of said supply terminals.

7. The reference current generator as claimed in claim 1, wherein with the exception of said transistor included in said active component, all its transistors operate in the saturated region.

8. The reference current generator as claimed in claim 3, wherein each of said branches includes a P-channel transistor and at least one N-channel transistor and wherein said transistor operating in the unsaturated region is an N-channel transistor.

9. The reference current generator as claimed in claim 4, wherein said output means comprises a transistor connected to the node between the transistors of opposite conductivity types in said at least one of said branches for being controlled by the voltage existing on said node to generate a reference current.

10. The reference current generator as claimed in claim 1, wherein said first and second branches each include at least one additional transistor connected in series with the transistors of the corresponding branch.

11. The reference current generator as claimed in claim 8, wherein said generator is implemented in an integrated circuit wherein the transistors of like conductivity type and/or operating in the like type of inversion are formed respectively as distinct physically contiguous groups on said integrated circuit and wherein at least one of the transistors in each group is formed of a predetermined number of unit transistors having the same dimensional characteristics and together forming said transistor.

12. The reference current generator as claimed in claim 11, further including switching transistors connected one each in series with the unit transistors of one of said transistor groups for enabling said series connected unit transistor to be selected, and logic circuit for selectively controlling said switching transistors.

* * * * *